US007503271B2

(12) United States Patent
Hayakawa

(10) Patent No.: US 7,503,271 B2
(45) Date of Patent: Mar. 17, 2009

(54) SEWING MACHINE CONTROL DEVICE AND MULTI-NEEDLE SEWING MACHINE

(75) Inventor: Atsuya Hayakawa, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 114 days.

(21) Appl. No.: 11/356,046

(22) Filed: Feb. 17, 2006

(65) Prior Publication Data

US 2006/0200268 A1 Sep. 7, 2006

(30) Foreign Application Priority Data

Mar. 4, 2005 (JP) ..... 2005-060816

(51) Int. Cl.
*D05B 19/00* (2006.01)

(52) U.S. Cl. ..... 112/470.01; 112/80.43; 112/98; 700/138

(58) Field of Classification Search ..... 112/80.43, 112/83, 84, 98, 100, 102.5, 470.01, 222; 700/130, 131, 132, 136, 138
See application file for complete search history.

(56) References Cited

U.S. PATENT DOCUMENTS 4,869,188 A * 9/1989 Hyodo ..... 112/445
6,012,402 A * 1/2000 Sekine ..... 112/102.5
6,980,877 B1 * 12/2005 Hagino et al. ..... 700/138
7,055,443 B2 * 6/2006 Goto et al. ..... 112/102.5
2002/0038162 A1 * 3/2002 Yamada ..... 700/138
2005/0178306 A1 * 8/2005 Hagino ..... 112/102.5
2005/0182508 A1 * 8/2005 Niimi et al. ..... 700/138
2005/0188906 A1 * 9/2005 Goto et al. ..... 112/102.5
2005/0283268 A1 * 12/2005 Hagino et al. ..... 700/138

FOREIGN PATENT DOCUMENTS

JP 06015072 A * 1/1994
JP A 6-15072 1/1994
JP A 2004-33538 2/2004

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A sewing machine control device includes a control unit for controlling the execution of a sewing operation based on sewing data including at least needle drop point data and thread color data of a sewing thread by selectively using a plurality of sewing needles respectively set with different color thread; a sewing needle-thread color storage medium storing sewing needle-thread color mapping data specifying the relation between sewing needles and thread color of thread respectively set thereto; a similarity evaluation unit for evaluating the similarity between the thread color specified by the thread color data and the thread color set to each sewing needle based on the thread color data and the sewing needle-thread color mapping data; and a sewing needle selection unit for selecting the sewing needle used for sewing in accordance with the sewing data based on evaluation result rendered by the similarity evaluation unit.

4 Claims, 8 Drawing Sheets

| SEWING NEEDLE NUMBER | THREAD COLOR |
|---|---|
| 1 | BLACK |
| 2 | RED |
| 3 | BLUE |
| 4 | GREEN |
| 5 | YELLOW |
| 6 | PURPLE |

FIG. 4

| | | R | G | B |
|---|---|---|---|---|
| 1 | BLACK | 0 | 0 | 0 |
| 2 | WHITE | 240 | 240 | 240 |
| 3 | RED | 237 | 23 | 31 |
| | | | | |
| | | | | |
| 15 | YELLOW | 255 | 255 | 0 |
| 16 | CREAM YELLOW | 255 | 240 | 141 |
| | | | | |

FIG. 5

| SEWING NEEDLE NUMBER | THREAD COLOR | MANUFACTURER | THREAD THICKNESS | MATERIAL |
|---|---|---|---|---|
| 1 | BLACK | COMPANY A | #50 | POLYESTER |
| 2 | RED | COMPANY A | #50 | POLYESTER |
| 3 | BLUE | COMPANY A | #50 | POLYESTER |
| 4 | GREEN | COMPANY A | #50 | POLYESTER |
| 5 | YELLOW | COMPANY A | #50 | POLYESTER |
| 6 | YELLOW | COMPANY B | #40 | POLYESTER |

FIG. 8

SEWING MACHINE CONTROL DEVICE AND MULTI-NEEDLE SEWING MACHINE

CROSS-REFERENCE TO RELATED APPLICATIONS

This application is based upon and claims the benefit of priority from the prior Japanese Patent Application No. 2005-060816, filed on Mar. 4, 2005 the entire contents of which are incorporated herein by reference.

TECHNICAL FIELD

The disclosure relates to a sewing machine control device and a multi-needle sewing machine that execute a sewing operation by selectively using a plurality of sewing needles in accordance with sewing data including needle drop point data and thread color data.

BACKGROUND

Conventionally, a multi-needle sewing machine has been used which is capable of consecutively sewing embroidery patterns that require the use of a plurality of thread colors. Such multi-needle sewing machine is provided with sewing data and a plurality of sewing needles. The sewing data includes thread color data that specifies a thread color and needle drop point data that specifies a needle drop point position for each stitch. A plurality of sewing needles is respectively attached to needle bars which are each set with a thread of different color.

The multi-needle sewing machine loads the sewing data upon starting a sewing operation. Then a switch is made to the sewing needle set with a thread having a thread color that matches with the loaded thread color data, and sewing operation is executed based on the loaded needle drop point data. Such sewing needle switching is carried out when replacing the thread color to be used for a sewing process. At this point, in case a sewing needle set with a thread that matches with the thread color specified in the thread color data does not exist, the user makes the replacement to the thread having a matching thread color.

A multi-needle sewing machine disclosed in JP-A-6-15072 is provided with a storage medium that stores thread type (thread color) data of the thread set to the sewing needle. The multi-needle sewing machine loads the sewing data upon embroidery sewing. Then, in case the sewing needle set with the thread having the thread color matching the thread color data specified in the sewing data does not exist, sewing operation is stopped to enable the replacement of the thread spool by the user.

Similarly, a sewing machine control device disclosed in JP-A-2004-33538 stops the sewing operation when a sewing needle set with a thread having a thread color matching the thread color data specified in the sewing data does not exist. Then, in the subsequent sewing operation, the sewing needle set with the least frequently used thread color is determined. Then the user is informed of a specific thread spool to be replaced so that highest replacement efficiency can be attained.

The thread replacement described above requires the user to set the sewing needle with the thread in addition to the replacement of the thread spool itself, which is a troublesome work for the user. Performing such operation upon every absence of matching thread color imposes considerable burden on the part of the user.

SUMMARY

Therefore an object of the present disclosure is to provide a sewing machine control device and a multi-needle sewing machine capable of reducing the user's burden upon thread replacement work in case a sewing needle set with a thread having a thread color matching with the thread color specified in thread color data of sewing data does not exist, or in case a sewing needle set with a thread having a thread type matching the thread type specified in thread specification data of the sewing data does not exist.

The sewing machine control device of the present disclosure is provided with a control unit that controls the sewing machine so as to execute a sewing operation by selectively using a plurality of sewing needles respectively set with a thread of different color based on the sewing data which at least includes needle drop point data and thread color data of the thread to be used for a sewing process; and a sewing needle-thread color storage medium that stores sewing needle-thread color mapping data capable of specifying a correspondence between the plurality of sewing needles and the thread color of the thread respectively set to each sewing needle. The control device of the sewing machine is further provided with a similarity evaluation unit that evaluates the similarity between the thread color specified by the thread color data and the thread color of the thread set to each sewing needle based on the thread color data and the sewing needle-thread color mapping data; and a sewing needle selection unit that selects, based on the evaluation result rendered by the similarity evaluation unit, the sewing needle to be used for the sewing process performed in accordance with the sewing data.

According to such construction, among the plurality of sewing needles set with threads of different thread colors, a sewing needle set with a thread which is similar to the thread color specified by the thread color data is determined as the sewing needle to be used for the sewing process. As a result, sewing can be performed with a similar thread color without thread replacement, thereby reducing the user's burden of thread replacement.

Also, the multi-sewing needle machine of the present disclosure is provided with a plurality of sewing needles respectively set with a thread of different type; a control unit that controls the sewing machine so as to execute a sewing operation by selectively using the plurality of sewing needles based on the sewing data which at least includes needle drop point data and thread specification data that specifies the type of thread to be used for a sewing process; and a sewing needle-thread type storage medium that stores sewing needle-thread type mapping data capable of specifying a correspondence between the plurality of sewing needles and the thread type of the thread respectively set to each sewing needle. The multi-needle sewing machine is further provided with a similarity evaluation unit that evaluates the similarity between the thread type specified by the thread specification data and the thread type of the thread set to each sewing needle based on the thread specification data and the sewing needle-thread type mapping data; and a sewing needle selection unit that selects the sewing needle to be used in the sewing process in accordance with the sewing data based on the evaluation result rendered by the similarity evaluation unit.

According to such construction, among the plurality of sewing needles set with threads of different thread types, the sewing needle set with the thread which is similar to the thread type specified by the thread specification data is determined as the sewing needle to be used for the sewing process. As a result, sewing can be performed with a similar thread type without having to replace the thread, thereby reducing the user's burden of thread replacement.

BRIEF DESCRIPTION OF THE DRAWINGS

Other objects, features and advantages of the present disclosure will become clear upon reviewing the following description of the illustrative aspects with reference to the accompanying drawings, in which.

FIG. 4 shows data contained in a table storing sewing needle-thread color mapping data;

FIG. 5 shows data contained in a table storing RGB value preset for each thread color for identifying a thread color;

FIG. 8 shows data contained in a table storing sewing needle thread type mapping data in an alternative illustrative aspect.

DETAILED DESCRIPTION OF THE PREFERRED EMBODIMENT

An embodiment of the present invention will be described hereinafter with reference to the drawings.

Figure 1:
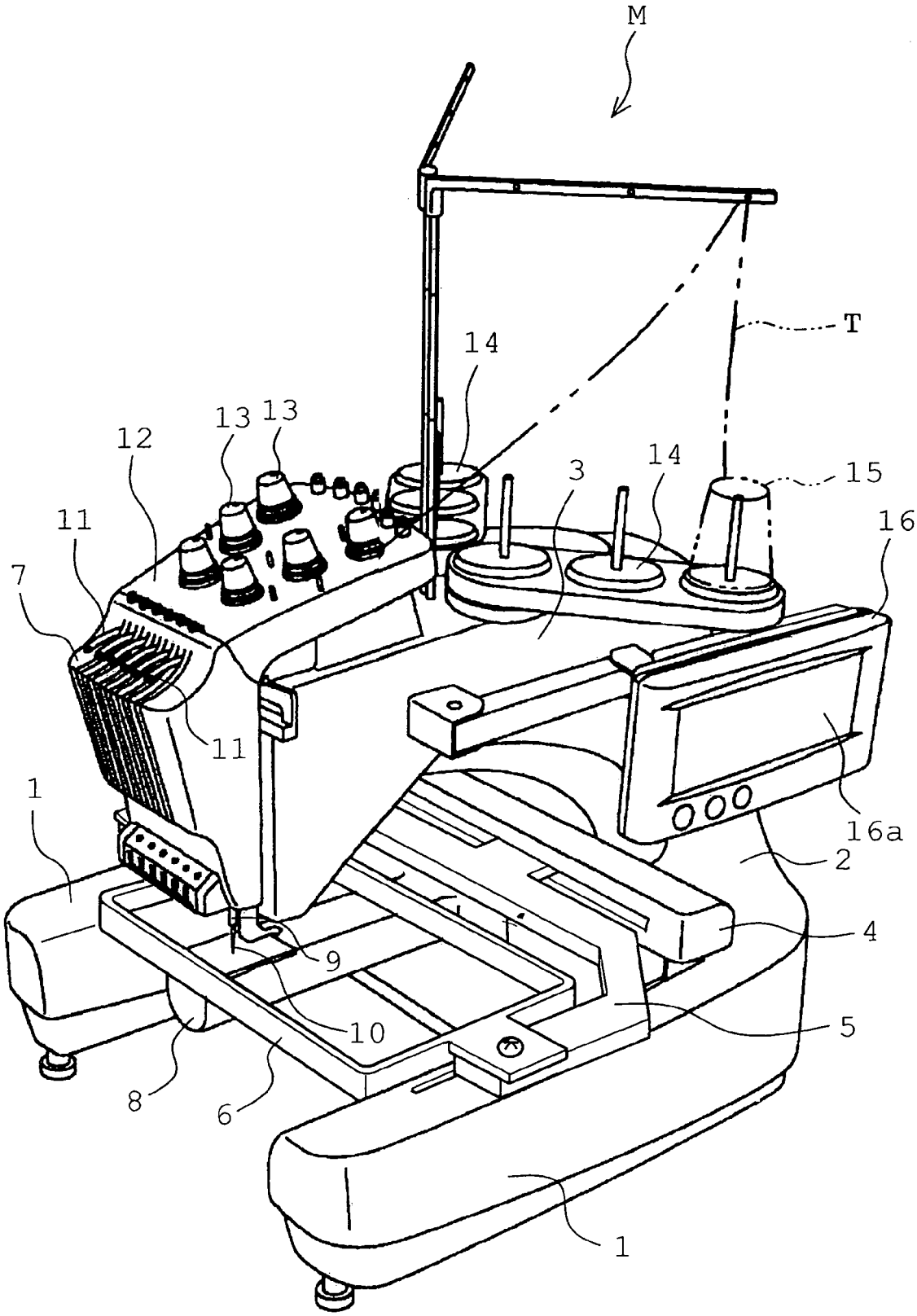
FIG. 1 is a perspective view of the disclosure, wherein a multi-needle sewing machine provided with a sewing machine control device is shown.

As shown in FIG. 1, a multi-needle sewing machine M is constructed by a foot 1 supporting the entire sewing machine, a pillar 2 standing on the rear end of the foot 1, and an arm 3 extending to the front from the upper portion of the pillar 2.

A movable case 4 is provided on the upper side of the foot 1. A frame mounting base 5 is provided on the front side of the movable case 4. A lateral drive mechanism equipped with an x-direction drive motor 33 (refer to FIG. 2) is provided inside the movable case 4. The frame mounting base 5 is laterally driven by the x-direction drive motor 33 (refer to FIG. 2). A longitudinal drive mechanism equipped with a y-direction drive motor 34 (refer to FIG. 2) is provided inside the foot 1. The movable case 4 is longitudinally driven by the y-direction drive motor 34. An embroidery frame 6 retaining a workpiece cloth to be sewn in a stretched manner is mounted on the frame mounting base 5. The frame mounting base 5 is moved in the lateral direction by the lateral drive mechanism and the movable case 4 is moved in the longitudinal direction by the longitudinal drive mechanism. Thus, the workpiece cloth mounted on the frame mounting frame 5 via the embroidery frame 6 is fed in longitudinal and lateral directions.

A needle bar case 7 mounted with a synthetic resin cover is attached on the front side of the arm 3. A cylindrical bed 8 extending to the underside of the needle bar case 7 which is disposed in the front side of the multi-needle sewing machine is provided in the pillar 2. In the needle bar case 7, six needle bars 9 are stored in a single lateral row. A sewing needle 10 is attached on the lower end of each needle bar 9. Also, six thread take-ups 11 in a single lateral row are mounted in the needle bar case 7. Each thread take-up 11 has a corresponding needle bar 9. A thread tension frame 12 made of synthetic resin and which is slightly inclined in the upper rear direction is fixed on the upper end of the needle bar case 7. Six thread tension regulators 13 are provided on the thread tension frame 12. Each thread tension regulator 13 is associated with needle thread T used by each sewing needle 10.

Six spool pin bases 14 are provided on the upper side of the arm 3. Thread spools 15 serving as thread supply are attached on such spool pin bases 14. The needle thread T drawn from each thread spool 15 is hooked on the corresponding thread tension regulator 13, thread take-up 11, and the like and supplied to the sewing needle 10.

A needle bar switching mechanism (not shown) having a needle bar switching motor 32 (refer to FIG. 2) is provided inside the arm 3. The needle bar case 7 is moved in the lateral direction integrally with the thread tension frame 12 by the needle bar switching mechanism. Thus, one of the six needle bars 9 and the thread take-ups 11 are selectively switched to the active position. When the sewing machine motor 31 (refer to FIG. 2) is driven, the sewing needle 10 is vertically driven via the needle bar 9 and the thread take-up 11. The sewing needle 10, in cooperation with a rotary hook (not shown) provided inside the cylinder bed 8, forms stitches on the workpiece cloth set on the upper side of the cylinder bed 8 by the needle thread T and a bobbin thread. An operation panel 16 of a touch-panel type is provided on the right side of the arm 3. The operation panel 16 is mounted on the arm 3 via a connection arm 17. The operation panel 16 is slidable in the axial direction of the connection arm 17, and can also be folded toward the rear end of the arm 3 along with the connection arm 17.

Next, an electronic configuration of the multi-needle sewing machine M will be described.

Figure 2:
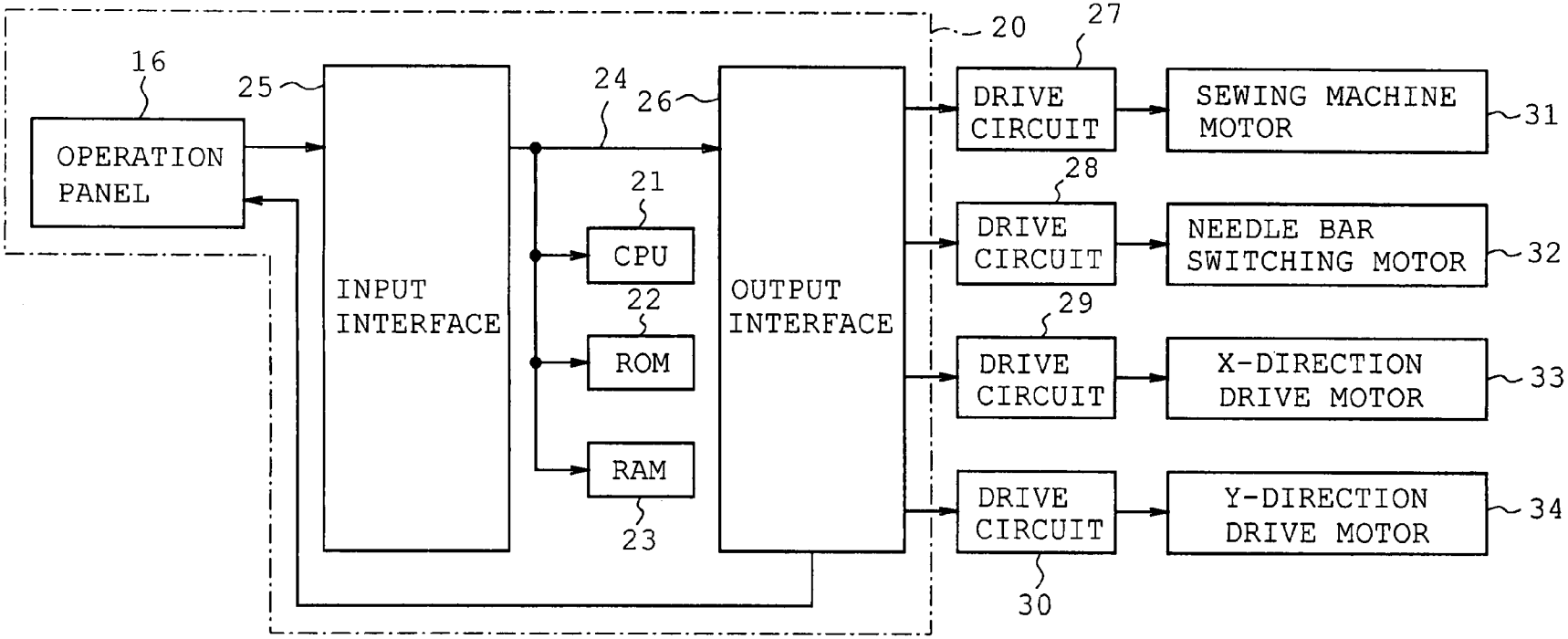
FIG. 2 is a block diagram of control systems of the multi-needle sewing machine.

As shown in FIG. 2, a sewing machine control device 20 is configured by a microcomputer including a CPU 21, a ROM 22, and a RAM 23; an input interface 25; an output interface 26; and the operation panel 16. The input and output interfaces 25 and 26 are connected to the microcomputer via a bus 24 such as a data bus.

The operation panel 16 is connected to the input interface 25. The operation panel 16, drive circuits 27, 28, 29 and 30 respectively provided for the sewing machine motor 31, needle bar switching motor 32, x-direction driving motor 33, and the y-direction drive motor 34 are connected to the output interface 26.

Figure 3:
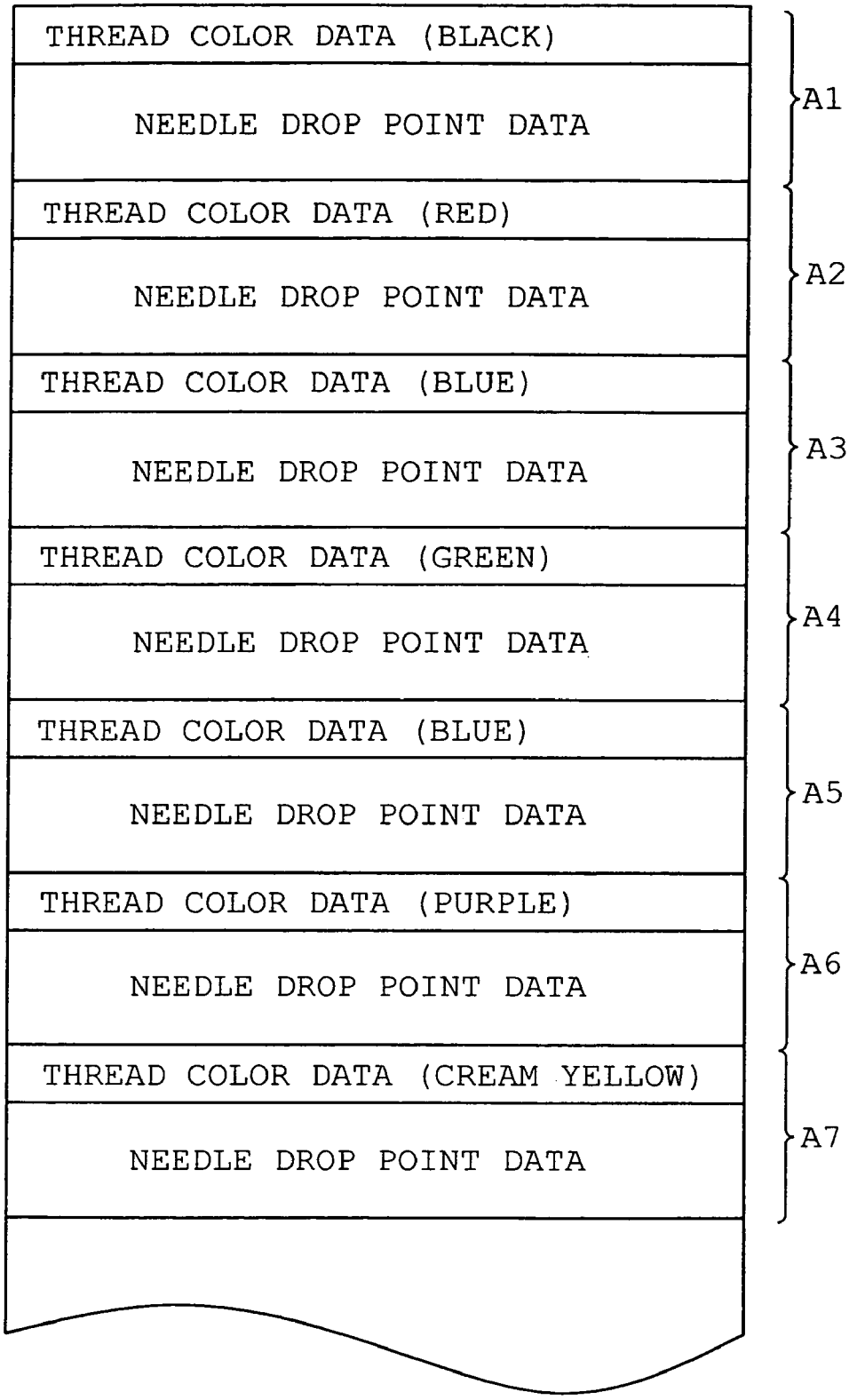
FIG. 3 is a data structure of sewing data including thread color data and needle drop point data.
Figure 6A:
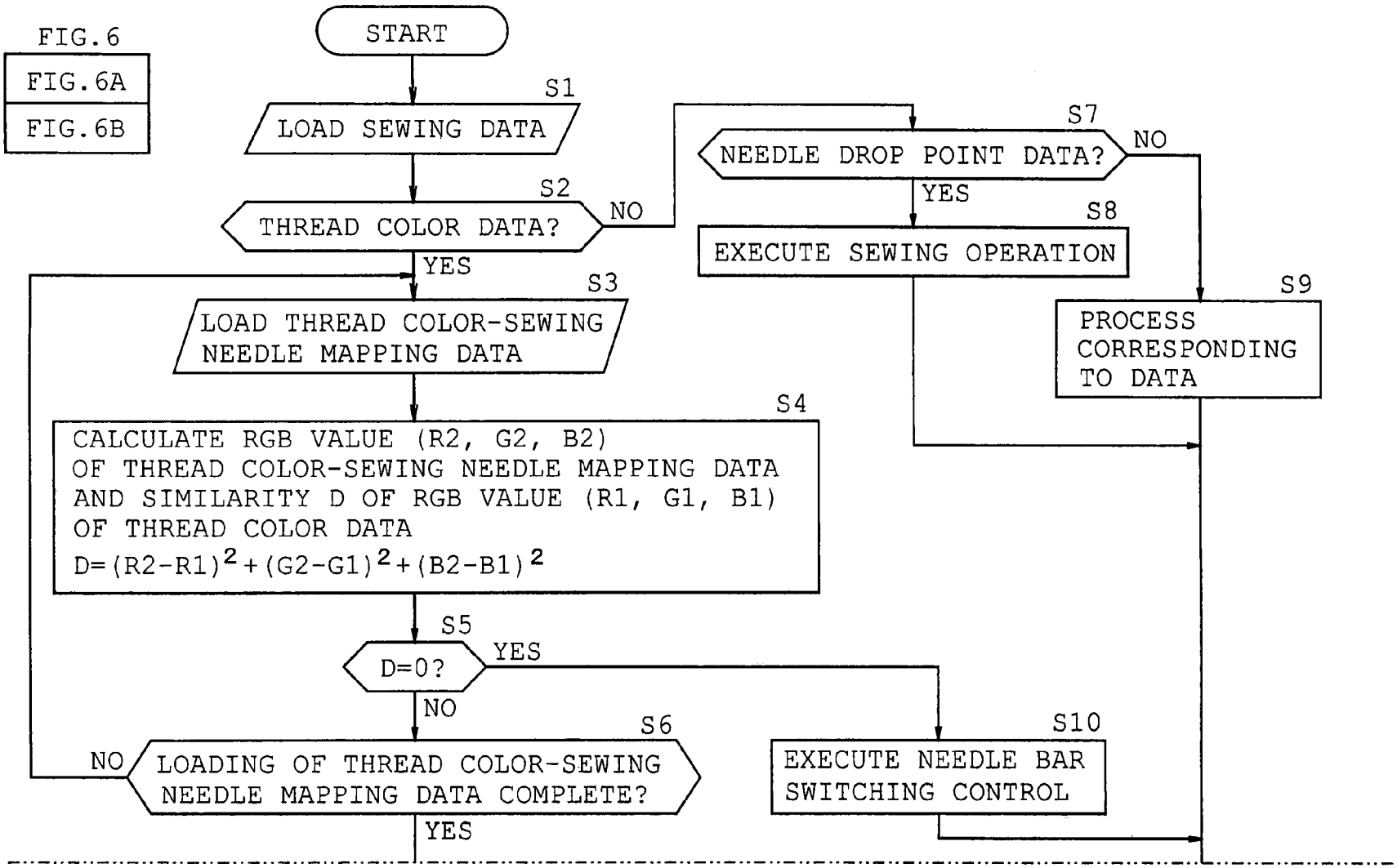
FIG. 6A is the first half of a flow chart for sewing needle selection control.
Figure 6B:
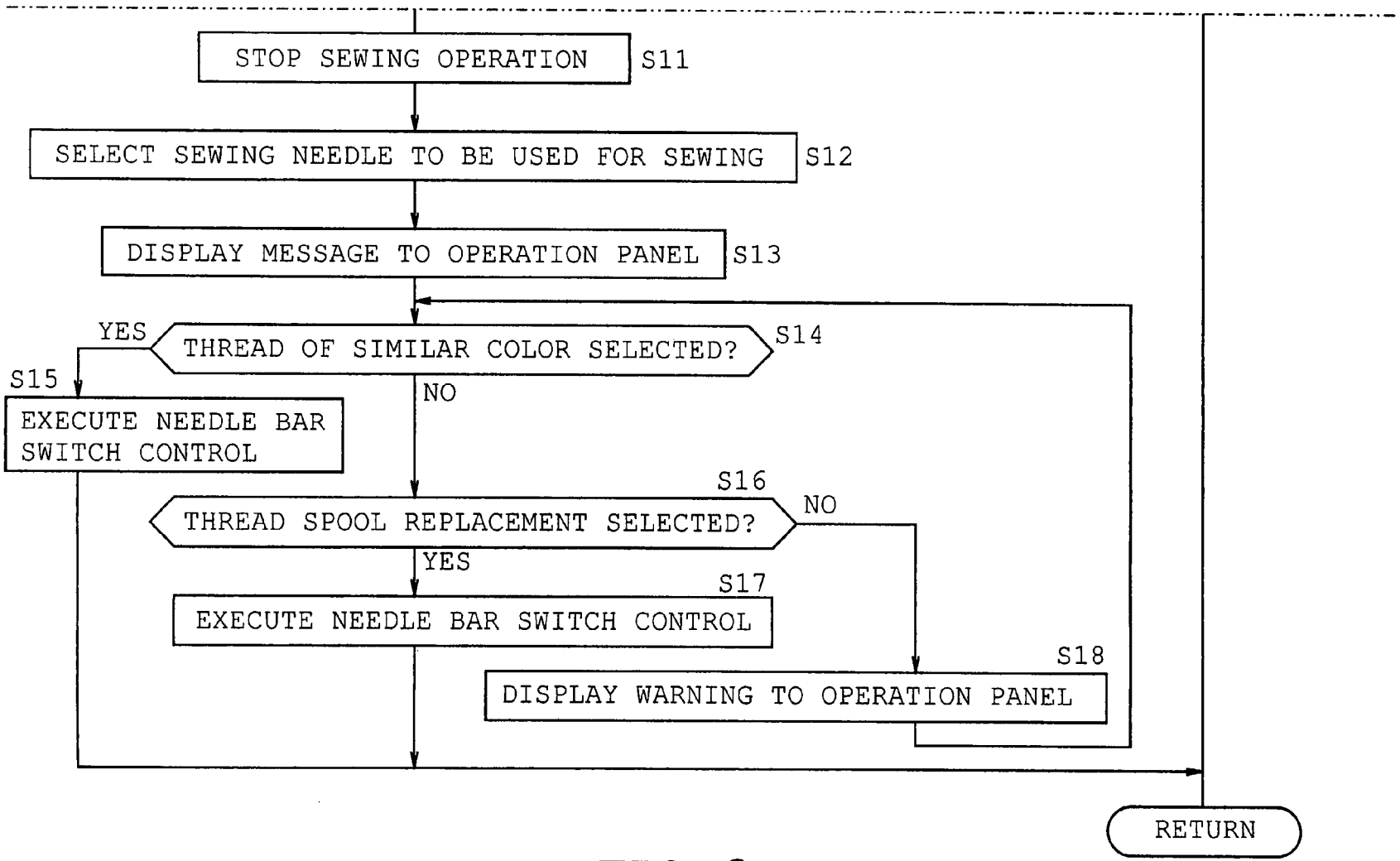
FIG. 6B is the second half of the flow chart for sewing needle selection control.

A control program, a sewing needle selection control program, sewing data, and the like are stored in the ROM 22. The control program controls the multi-needle sewing machine M. The sewing needle selection control program, as shown in FIGS. 6A and 6B, selects a sewing needle 10 set with a needle thread T similar to the thread color specified by a later described thread color data from the plurality of sewing needles 10 set with needle threads T of different thread colors. The sewing data is provided for performing embroidery sewing. The sewing data stored in the ROM 22, as shown in FIG. 3, includes the thread color data indicating the thread color of needle thread T to be used for the sewing process and the needle drop point data indicating the needle drop point for the sewing process. The thread color data and the needle drop point data are set in each sewing area (A1 to A7 in FIG. 3) within a sewing pattern. The sewing area contains one or more consecutive stitches formed by the same color of needle thread T. The sewing data is used by the multi-needle sewing machine M by being loaded into the RAM 23 upon sewing process or pattern editing process. The sewing data may be stored not only in the built-in ROM 22 storage but also be in an external storage medium such as a flexible disk or a ROM cartridge and loaded into the RAM 23 from such external storage medium.

As shown FIG.4, a sewing needle-thread color mapping data specifying a correspondence between the six sewing needles 10 and the thread colors of the needle threads T respectively set to each sewing needle 10 is stored in the RAM 23. Also, as shown in FIG. 5, a table containing preset RGB values for each thread color is stored in the RAM 23. The RGB value is used to identify a thread color.

The sewing needle-thread color mapping data can be set by user input from the operation panel 16. Upon initial use of the multi-needle sewing machine M, the sewing needle-thread color mapping data is stored in the RAM 23 by the user's input of the thread color of the needle thread T set on each sewing needle 10. Thereafter, in case the user changes the needle thread T set for each sewing needle 10, such change can be updated to the sewing needle-thread color mapping data by user input via the operation panel 16. Also, the sewing needle-thread color mapping data stored in the RAM 23 may be stored in a nonvolatile memory such as an EEPROM (not shown) provided in the multi-needle sewing machine. In such case, the sewing needle-thread color mapping data can be used by loading the same to the RAM 23 upon turning on the power supply to restart the embroidery sewing process.

Figure 7:
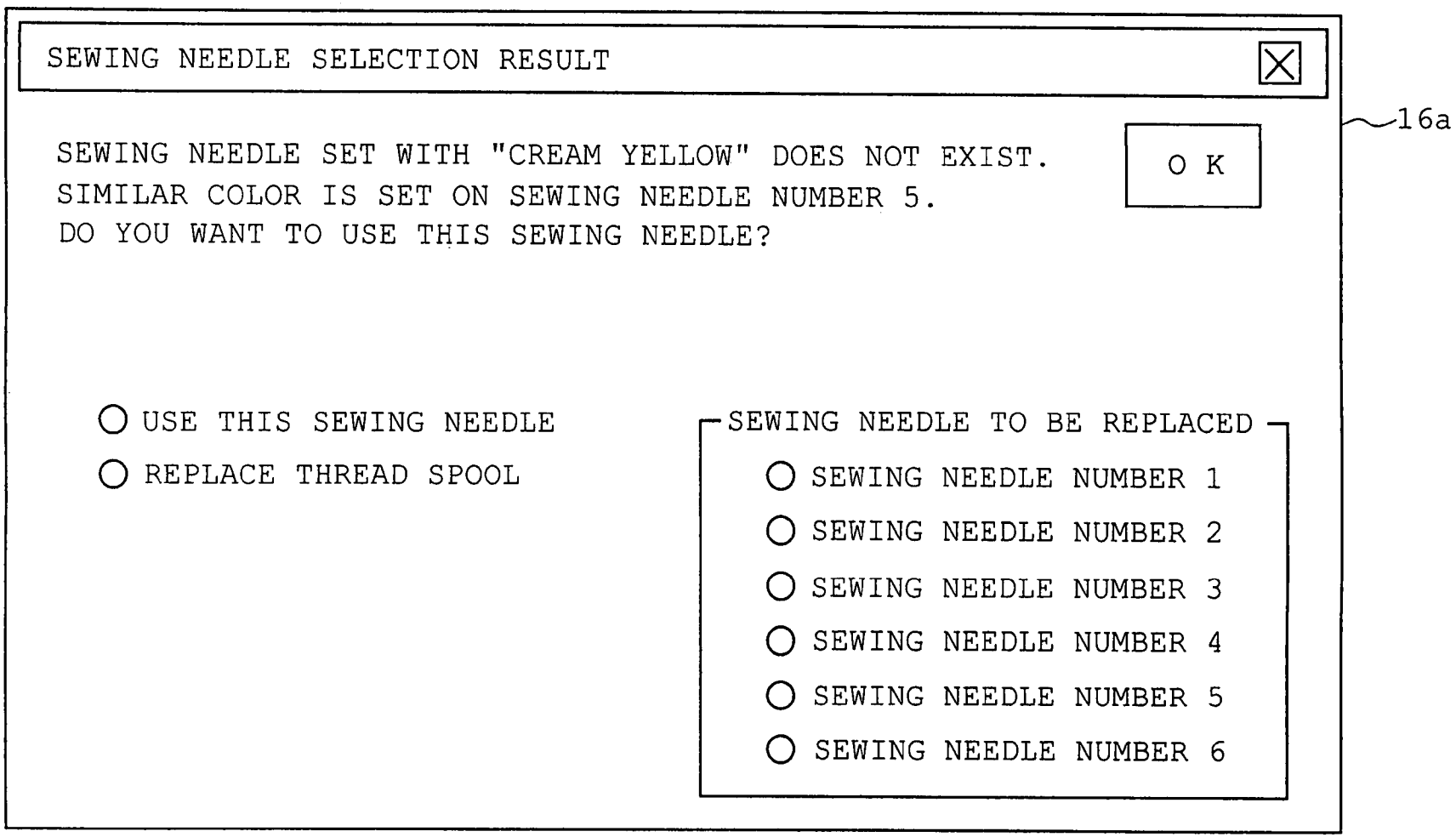
FIG. 7 is an example of screen display of sewing needle determination result.

The operation panel 16 is controlled by the microcomputer. As shown in FIG. 7, a selection result screen is displayed on a display portion 16*a* of the operation panel 16. When replacing the thread color, in case a sewing needle 10 set with a needle thread T that matches with the thread color specified by the thread color data does not exist, a sewing needle number of the sewing needle 10 set with needle thread T having a thread color which is similar to the thread color specified in the thread color data is displayed on the selection result screen. Also, whether to use the selected sewing needle 10 or to replace the thread spool 15 can be selected by a touch operation of the operation panel 16.

In case the user chooses to use the selected sewing needle 10, the sewing machine control device 20 activates the needle bar switching motor 32 by the drive circuit 28 and switches the needle bar 9 set with the selected sewing needle 10 to the active position. Then the sewing machine motor 31 is driven by the drive circuit 27 and the sewing process is executed by the selected sewing needle 10. On the other hand, in case the user chooses to replace the thread spool 15 and selects one of the sewing needles 10 identified by the sewing needle numbers 1 to 6, the sewing machine control device 20 switches the needle bar 9 set with the selected sewing needle 10 to the active position. Then by driving the sewing machine motor 31 by the drive circuit 27, sewing is executed by the selected sewing needle 10.

Next, a flow chart depicting the sewing needle selection control executed by the sewing machine control device 20 will be described based on FIGS. 6A and 6B. The symbols Si (i=1,2,3, . . . ) in the figure indicate each step number.

When the user sets the embroidery frame 6 holding the workpiece cloth to the frame mounting base 5 and starts the sewing operation by the multi-sewing needle sewing machine M, the sewing machine control device 20 loads the sewing data from the RAM 23 (S1). Then, the process proceeds to step S2 and determination is made whether the loaded sewing data is a thread color data or not. In case the loaded sewing data is a thread color data, the sewing machine control device 20 makes a yes decision and proceeds to step S3 where the sewing needle-thread color mapping data is loaded from the RAM 23. Next, the sewing machine control device 20 proceeds to step S4. In step S4, the similarity D of the thread color specified in the thread color data and thread color of needle thread T set to each sewing needle 10 is calculated based on the RGB value of the thread color data and the thread color-sewing needle mapping data. At this point, the RGB value of the thread color specified in the thread color data and the sewing needle-thread color mapping data can be obtained by referring the table shown in FIG. 5. The sewing machine control device 20 calculates the similarity D from the following formula by using the RGB value (R1, G1, B1) of the thread color data in the sewing data and the RGB value (R2, G2, B2) of the thread color of the thread color-sewing needle mapping data.

$$D=(R2-R1)^2+(G2-G1)^2+(B2-B1)^2$$

It needs to be noted that the smaller the value of similarity D, the higher the similarity of the two colors.

The sewing machine control device 20, after calculating the similarity D, proceeds to step S5. In step S5, a judgment is made whether the calculated similarity D is zero or not; that is, whether or not the sewing needle 10 is set with needle thread T having a thread color matching the thread color specified in the thread color data or not. In case the similarity D calculated is 0, the sewing machine control device 20, after making a Yes decision, proceeds to step S10 where the needle bar switching control for switching the needle bar 9 set with the relevant sewing needle 10 is executed, and the control is returned.

In the above mentioned step S2, in case the loaded sewing data is not a thread color data, the sewing machine control device 20 makes a No decision and proceeds to step S7 where a judgment is made whether the loaded sewing data is a needle drop point data or not. In case the loaded sewing data is a needle drop point data, the sewing machine control device 20, after making a Yes decision, moves on to step S8 where the sewing operation by the sewing needle 10 is executed and the process is returned. On the other hand, in the above step S7, in case the loaded sewing data is not a needle drop point data, that is, in case of data indicating a stop or a termination of sewing operation, the sewing machine control device 20, after making a No decision, proceeds to step S9. In step 9, a process in accordance with the given data is executed and the control is returned.

In the above step S5, in case the similarity D calculated by the aforementioned formula is not 0; that is, in case a sewing needle 10 set with a needle thread T matching the thread color specified by the thread color data is not detected, the sewing machine control device 20 makes a No decision and proceeds to step S6. In step S6, a judgment is made whether the loading of the thread color-sewing needle mapping data is completed or not. In case loading is not completed, the sewing machine control device 20 makes a No decision and proceeds to step S3. Thereafter, the process in steps S3 to S6 are executed until the similarity D in step S5 amounts to 0, or loading of the sewing needle-thread color mapping data for each sewing needle 10 in step S6 is completed.

Then, in the above step S6, in case the loading of the sewing needle-thread color mapping data for all the sewing needles 10 is completed; that is, in case the sewing needle 10 set with the needle thread T matching the thread color specified in the thread color data is not detected, the sewing machine control device 20 makes a Yes decision. Then, the process proceeds to step S11 (refer to FIG. 6B) and stops the sewing operation of the multi-needle sewing machine M.

Next, the sewing machine control device 20 proceeds to step S12 and judges the sewing needles 10 having the lowest similarity D among the six sewing needles 10. The sewing needle 10 set with the thread color which is most similar to the thread color specified in the thread color data is selected as the sewing needle 10 to be used for the sewing process. Then the sewing machine control device 20 proceeds to step S13 and as shown in FIG.7, displays the selection result to the display portion 16*a* of the operation panel 16. Next, the sewing machine control device 20 proceeds to step S14 and judges whether the selected sewing needle 10 has been chosen or not; that is, whether the sewing needle 10 set with the similar thread color has been chosen or not. In case the user chooses the selected sewing needle 10 by touching the screen displayed on the display portion 16*a*, the relevant sewing needle 10 is determined as the sewing needle 10 to be used for the sewing process. Then the sewing machine control device 20, after making a Yes decision, proceeds to step S15. In step S15, the needle bar switching control is executed in order to perform the sewing operation with the selected sewing needle 10 and the control is returned.

On the other hand, in the above step S14, in case "replace thread spool" is selected on the screen displayed on the display portion 16*a*, the sewing machine control device 20 makes a No decision and proceeds to step S16 where the sewing needle number of the selected sewing needle 10 is identified. Then, in case the sewing needle 10 to be replaced has been selected, the sewing machine control device 20, after making a Yes decision, proceeds to step S17 and executes the needle bar switching control. In the needle bar switching control, the sewing machine control device 20 switches the needle bar 9 set with the relevant sewing needle 10 to the active position in order to enable the user to perform the sewing operation with the sewing needle 10 set with the new needle thread T drawn from the replaced thread spool 15. Also, upon processing step S17, among the sewing needle-thread color mapping data stored in the RAM 23, the sewing machine control device 20 updates the thread color corresponding to the replaced sewing needle 10 with the thread color of the newly set needle thread T.

In the above step S16, in case the sewing needle 10 to be replaced is not selected, the sewing machine control device 20 makes a No decision. Then the sewing machine control device 20 displays a warning message to the display portion 16*a* indicating that the sewing needle 10 to be replaced has not been selected. Then, the process is returned to step S14.

According to the present embodiment described above, among the plurality of sewing needles 10 set with needle threads T of different thread colors, the sewing needle 10 set with the needle thread T similar to the thread color specified by the thread color data is determined as the sewing needle 10 to be used for the sewing process. As a result, sewing can be performed with the similar thread color without replacement of the needle thread T, thereby reducing the user's burden of having to replace the thread spool.

In case the sewing needle 10 set with the needle thread T matching the thread color specified in the thread color data is detected, the detected sewing needle 10 can be used for the sewing process. On the other hand, in case the sewing needle 10 set with the matching thread color is not detected, the sewing operation of the multi-needle sewing machine M is stopped and the sewing needle 10 set with the needle thread T having the similar thread color can be used for the sewing process.

Furthermore, the selected sewing needle 10 is displayed to the operation panel 16 enabling the user to decide whether to use the selected sewing needle 10 for the sewing process or not via the operation panel 16. Thus, the sewing needle 10 set with the needle thread T having the similar thread color need not be searched by the user, thereby reducing the user's burden.

Also, by allowing the user him/herself to decide whether to use the similar thread or replace the thread spool 15, the freedom of thread selection is increased. Additionally, according to the present embodiment, the frequency of thread spool replacement can be reduced as compared to what has been conventionally required.

Yet, furthermore, the sewing operation by the selected sewing needle 10 can be easily restarted by the touch operation of the operation panel 16, thereby reducing the user's burden.

Also, since the detection of consistency between the thread color specified in the thread color data and the thread color of the needle thread T set to each sewing needle 10, as well as the selection of similarity is performed based on the RGB value that specifies the thread color. Therefore a complex construction for determining the thread color is not required. This allows for a provision of a simply configured sewing machine control device 20, which also yields cost advantage.

The present invention is not limited to the embodiment described above and illustrated in the drawings but can be transformed or expanded as follows.

Alternative to the sewing needle-thread color mapping data, as shown in FIG. 8, sewing needle-thread type mapping data may be used which is capable of specifying the correspondence between the six sewing needles 10 and the type of needle thread T set to each sewing needle 10. Also, thread specification data capable of specifying the thread type can be used instead of the thread color data. The type of needle thread T in this context includes data such as the thread color, manufacturer (corresponding to thread supplier), thread thickness, and thread material or the like. In this case, the sewing needle-thread type mapping data is stored in a sewing needle-thread type storage medium. According to such construction, even if a plurality of sewing needles is set with a thread color having the highest similarity with the thread color specified by the thread specification data, the similarity can be further determined by other data such as the manufacturer, thread thickness and thread material.

Thus, the similarity D can be determined based on not only by the thread color but also by the thread thickness, manufacturer and thread material, thereby further improving the accuracy in sewing needle selection. Similarity D can also be determined based on a thread number assigned by the manufacturer.

In the above described embodiment, the calculation process of similarity D based on the thread color data in the sewing data and sewing needle-thread color mapping data; and the detection process that determines whether the sewing needle 10 set with the thread having the matching thread color exists or not is performed upon every execution of the sewing process by each sewing needle 10. Alternatively, such calculation and detection process can be performed in prior to the sewing process. For instance, in prior to the start of sewing operation by the multi-needle sewing machine M, a predetermined number (for example, the first six colors) of thread color data can be loaded from the sewing data. Then, the aforementioned calculation process of similarity D and the detection process of the sewing needle 10 can be performed for such predetermined number of thread color data.

Furthermore, the above described determination process in steps S14 and thread spool replacement process in step S16 can be performed in prior to the start of the sewing process.

In the above described embodiment, upon calculating similarity D, the thread color specified by the thread color data and the thread color in the sewing needle-thread color mapping data are associated with an RGB value by referring FIG. 5. Alternatively, the thread color specified in the thread color data and the thread color in the sewing needle-thread color mapping data can be stored in the form of RGB value in advance.

In the above described embodiment, the operation panel 16 of a touch-panel type is provided which integrally assumes the functions of the informing unit and the operation unit. Alternatively, a display serving as the informing unit and operation keys serving as the operation unit can be provided separately.

Also, the informing unit may be provided as a light-emitting device composed of a plurality of light-emitting diodes or a buzzer, or the like. In such case, the sewing needle 10 to be switched can be informed to the user by changing the color of the light emitted by the light-emitting device or by changing the sound of the buzzer.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

I claim:

1. A multi-needle sewing machine comprising:

a plurality of sewing needles respectively set with a thread of different type;

a control unit that controls the sewing machine so as to execute a sewing operation by selectively using the plurality of sewing needles in accordance with sewing data which at least includes needle drop point data and thread specification data that specifies a type of thread to be used for a sewing process, wherein thread specification data comprises thread color and at least one selected from the group consisting of thread material, a thread thickness and a thread manufacturer;

a sewing needle-thread type storage medium that stores sewing needle-thread type mapping data capable of specifying a correspondence between the plurality of sewing needles and the thread type of the thread respectively set to each sewing needle;

a similarity evaluation unit that evaluates, based on the thread specification data and the sewing needle-thread type mapping data, the similarity between the thread type specified by the thread specification data and the thread type of the thread set to each sewing needle; and a sewing needle selection unit that selects, based on an evaluation result rendered by the similarity evaluation unit, the sewing needle to be used for the sewing process performed in accordance with the sewing data.

2. The multi-needle sewing machine according to claim 1, further comprising:

a sewing needle detection unit that detects, based on the thread specification data and the sewing needle-thread type mapping data, the sewing needle set with the thread having the thread type that matches with the thread type specified in the thread specification data, wherein when the sewing needle set with the thread of a matching type is detected by the sewing needle detection unit, the control unit determines the detected sewing needle as the sewing needle to be used for the sewing process and executes a sewing operation by the determined sewing needle, wherein when the sewing needle set with the thread of the matching type is not detected by the sewing needle detection unit, the control unit stops the sewing operation while enabling the sewing needle selection unit and determines the sewing needle to be used for the sewing process based on the selection result rendered by the sewing needle selection unit.

3. The multi-needle sewing machine according to claim 1, further comprising an informing unit that informs of the sewing needle selected by the sewing needle selection unit, and an operation unit that determines the sewing needle informed of by the informing unit as the sewing needle to be used for the sewing process.

4. The multi-needle sewing machine according to claim 3, further comprising a sewing instruction unit that instructs, based on an operation of the operation unit, execution of the sewing process by the sewing needle selected by the sewing needle selection unit.

* * * * *